US005462472A

United States Patent [19]

Lin

[11] Patent Number: 5,462,472

[45] Date of Patent: Oct. 31, 1995

[54] MAGNETIC INDUCTION TOY

[76] Inventor: Mon S. Lin, 5th Fl. No. 4, Lane 7, Pao Kao Road, Hsintien, Taipei Hsien, Taiwan

[21] Appl. No.: 229,904

[22] Filed: Apr. 19, 1994

[51] Int. Cl.[6] ..... A63H 33/26

[52] U.S. Cl. ..... 446/135; 446/133; 446/484; 40/426

[58] Field of Search ..... 446/129, 130, 446/133, 134, 135, 136, 484; 40/426

[56] References Cited

U.S. PATENT DOCUMENTS

| | | | |
|---|---|---|---|
| 312,178 | 2/1885 | Bacon | 446/129 |
| 962,069 | 6/1910 | Walters et al. | 40/426 |
| 2,974,265 | 3/1961 | Thoma | 446/484 |
| 3,717,951 | 2/1973 | Ljungdahl | 446/130 |
| 4,157,630 | 6/1979 | Sawai | 446/130 |
| 4,727,299 | 2/1988 | Liu | 446/484 |
| 4,728,871 | 3/1988 | Andrews | 446/484 |
| 5,370,569 | 12/1994 | Mo-Hsin | 446/133 |

FOREIGN PATENT DOCUMENTS

| | | | |
|---|---|---|---|
| 1233884 | 5/1986 | U.S.S.R. | 446/129 |

*Primary Examiner*—Robert A. Hafer
*Assistant Examiner*—Jeffrey D. Carlson
*Attorney, Agent, or Firm*—Bacon & Thomas

[57] ABSTRACT

A magnetic induction toy includes a casing cowered with a cover to hold a battery, a holder frame fixed within the casing to hold an electromagnet and a rocker arm by a pivot pin, the electromagnet being connected to the battery, the rocker arm having a top permanent magnet repulsed or attracted by a permanent magnet placed above the cover and two lateral permanent magnets to repulse against the electromagnet, and round ornaments placed above the cover, each round ornament having at least one permanent magnet respectively reacted with the top permanent magnet on the rocker arm such that said rocker arm is induced to oscillate on the pivot pin by placing the operation control permanent magnet on the cover with one pole facing toward the permanent magnet on the base of the rocker arm to produce a magnetic repulsion and then moving the operation control permanent magnet along a course guide sign, the rocker arm being stopped by placing the other pole of the operation control permanent magnet on the cover toward the permanent magnet on the base of the rocker arm to produce a magnetic attraction.

2 Claims, 4 Drawing Sheets

MAGNETIC INDUCTION TOY

BACKGROUND OF THE INVENTION

The present invention relates to a magnetic induction toy which is induced by a magnetic force to move ornaments.

A variety of toys are manufactured for children to play with. The present invention provides a toy which attracts children to play with.

According to the present invention, magnetic attraction and repulsion forces are employed to move round dolls causing them to rock in any of a variety of directions. According to an alternate form of the present invention, model fishes with permanent magnets are placed in a water container to react with a permanent magnet on a rocker arm beneath the water container, and a fishing tackle is suspended above the water container to simulate the act of fishing. A dual-coil electromagnet which consumes electric current about 3–4 MA is placed inside the housing of the toy to react with permanent magnets on two opposite sides of the rocker arm in causing the rocker arm to rock regularly. The whole assembly of the toy is inexpensive to manufacture and easy to assemble.

DETAILED DESCRIPTION OF THE PREFERRED EMBODIMENTS

Figure 1:
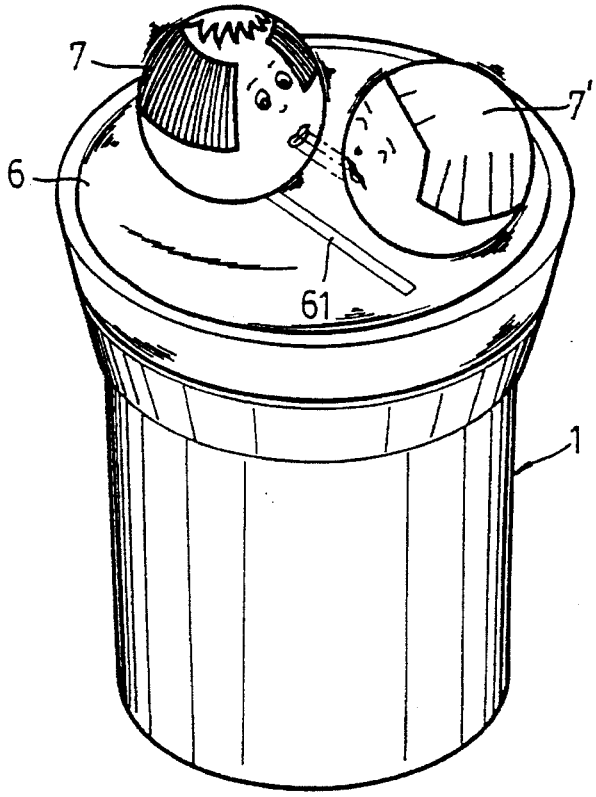
FIG. 1 is an elevational view of an ornamental toy embodying the present invention.
Figure 2:
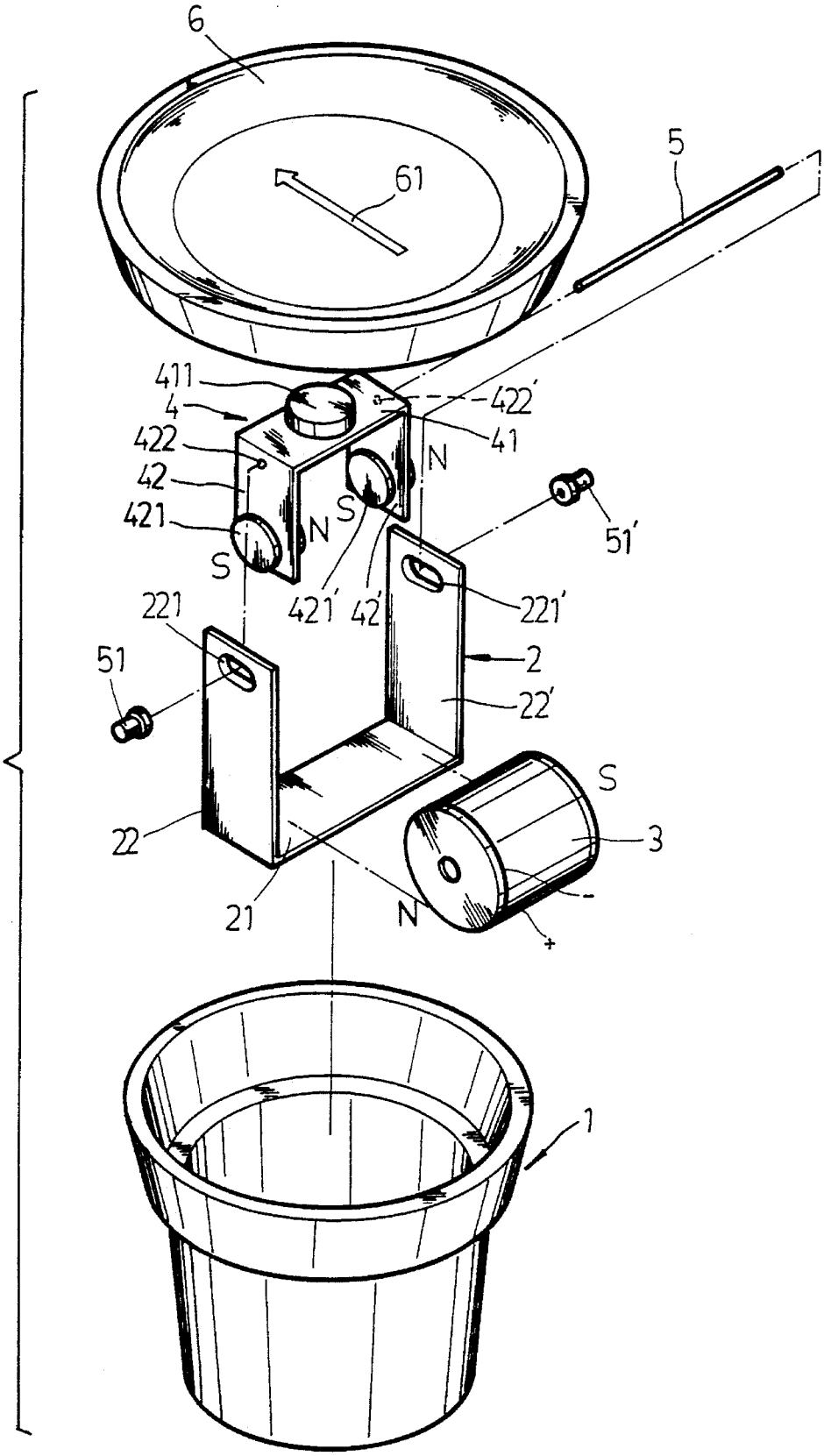
FIG. 2 is an exploded view thereof.

Referring to FIGS. 1 and 2, an ornamental toy in accordance with the present invention is generally comprised of a cylindrical top-open casing 1, a substantially U-shaped holder frame 2, an electromagnet 3, a substantially U-shaped rocker arm 4, a pivot pin 5, a cover 6, and ornaments 7;7'. The holder frame 2 is fixed within the casing 1 at the bottom. The rocker arm 4 is fastened to the holder frame 2 to hold the electromagnet 3. The cover 6 covers the casing 1 at the top to carry ornaments 7;7'.

Figure 4:
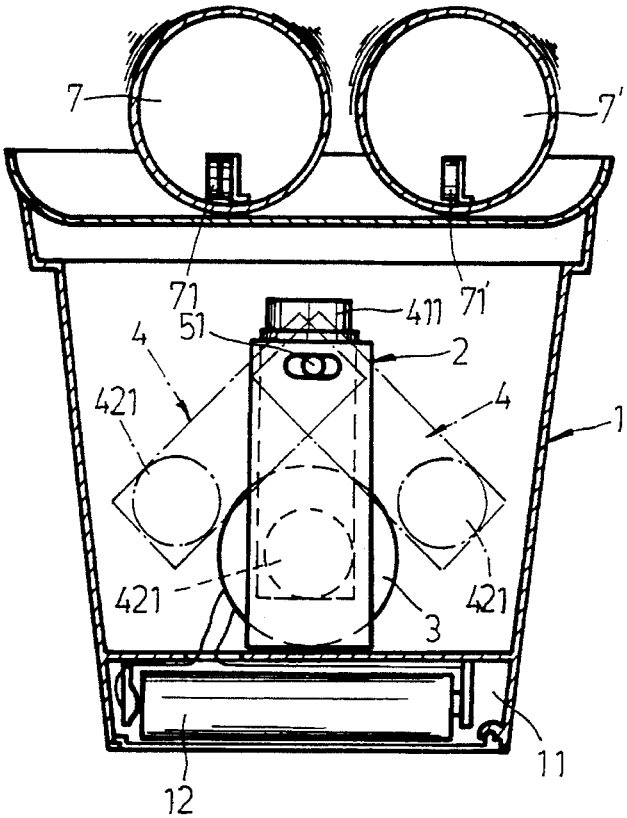
FIG. 4 is a plan view showing the rocker arm oscillated to move the ornaments above the cover.
Figure 7:
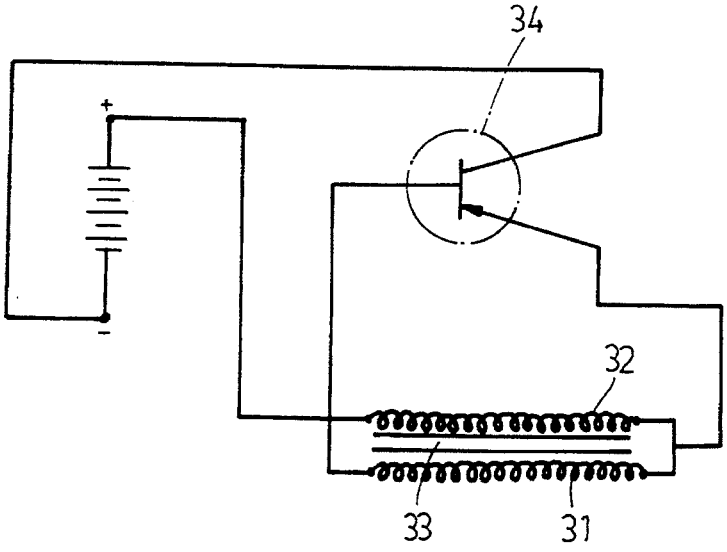
FIG. 7 is a circuit diagram of the present invention.

Referring to FIGS. 4 and 7 and FIGS. 1 and 2 again, the casing 1 comprises a battery chamber 11 at the bottom, which receives a battery 12. The holder frame 2 comprises a flat horizontal wall 21 fixed to the casing 1 above the battery chamber 11, and two vertical side walls 22;22' vertically extended upwards from the two opposite ends of the flat horizontal wall 21. Each vertical side wall 22 or 22' has an elongated slot 221 or 221' transversely disposed near the respective topmost edge. The electromagnet 3 is electrically connected to the battery 12, and comprised of a primary coil 31, a secondary coil 32, an iron core 33, and a transistor 34 having a base B, collector C, and emitter E. The rocker arm 4 comprises two unitary side bars 42;42' vertically extended downwards from two opposite ends of a horizontal base 41 thereof, a top permanent magnet 411 fastened to the horizontal base 41 at the top in the middle, two permanent magnets 421;421' respectively fastened to the side bars 42;42'. The polarity of the permanent magnet 421 or 421' on either side bar 42 or 42' is equal to the adjacent end of the electromagnet 3. Two pin holes 422;422' are respectively made on the side bars 42;42' of the rocker arm 4. The pivot pin 5 is inserted through the slots 221;221' on the side walls 22;22' of the holder frame 2 and the pin holes 422;422' on the side bars 42;42' of the rocker arm 4, with its two opposite ends respectively fastened to the side walls 22;22' of the holder frame 2 by caps 51;51'. Therefore, the rocker arm 4 can be moved back and forth alternatively on the pivot pin 5 within the holder frame 2. The cover 6 is made in the shape of a circular dish having a bottom end fitted into the top opening of the casing 1. Two round ornaments 7;7' are placed on the cover 6, one having two permanent magnets 71 on the inside and the other having one permanent magnet 71' on the inside. A course guide sign 61 is printed on the cover 6 to indicate the rocking direction of the rocker arm 4.

Figure 3:
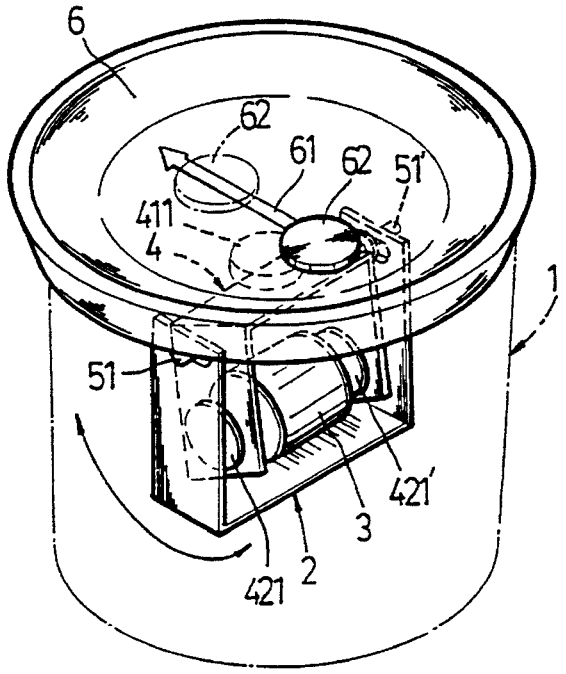
FIG. 3 is a perspective view showing the rocker arm induced to start rocking.
Figure 5:
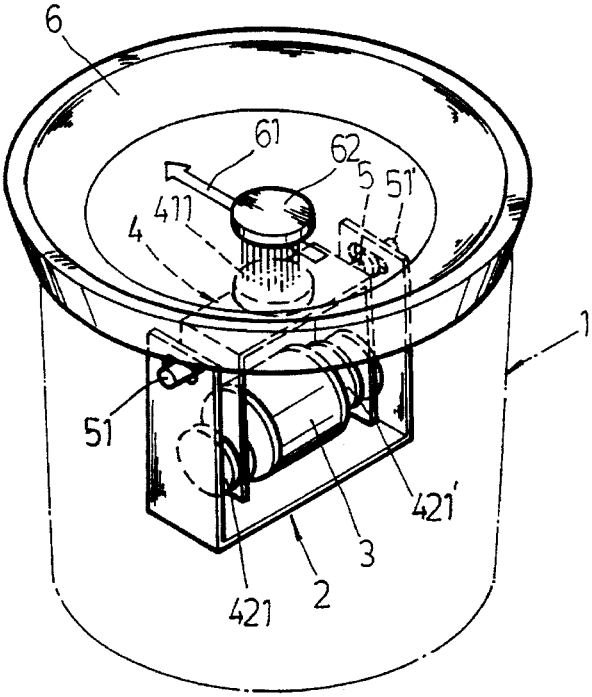
FIG. 5 is a perspective view showing the actuating and stop control permanent magnet placed on the cover to stop the movement of the rocker arm.

Referring to FIGS. 3, 4 and 5, an actuating and stop control permanent magnet 62 is provided and moved along the course guide sign 61 to actuate the rocker arm 4. While moving the permanent magnet 62 along the course guide sign 61 with one pole, the rocker arm 4 is caused to oscillate by means of the magnetic repulsion between the permanent magnet 411 on the horizontal base 41 and the permanent magnet 62 being moved on the cover 6. As the rocker arm 4 is induced to oscillate, the primary coil 31 of the electromagnet 3 is caused to provide a weak voltage (about 0.6 V) to the base of the transistor 34. Upon receipt of the voltage, the emitter of the transistor 34 is electrically connected to provide a positive power supply through the secondary coil 32, and therefore the iron core 33 is activated to produce a magnetic field. As the electromagnet 3 is activated, a magnetic repulsion will be produced each time the permanent magnet 421 or 421' on either side bar 42 or 42' passes by. Therefore, the rocker arm 4 can be maintained oscillating regularly. Then, two pre-prepared round ornaments 7;7' are placed on the cover 6 to react with the permanent magnet 411 on the base 41 of the rocker arm 4. By means of the effect of magnetic repulsion and magnetic attraction between the permanent magnets 71,71' of the ornaments 7;7' and the permanent magnet 411 on the base 41 of the rocker arm 4, the ornaments 7;7' are caused to rock on the cover 6. Putting the actuating and stop control permanent magnet 62 on the cover 6 with the opposite pole facing toward the permanent magnet 411 on the base 41 of the rocker arm 4 produces a magnetic attraction, and therefore the rocker arm 4 is caused to stop its movement.

Figure 6:
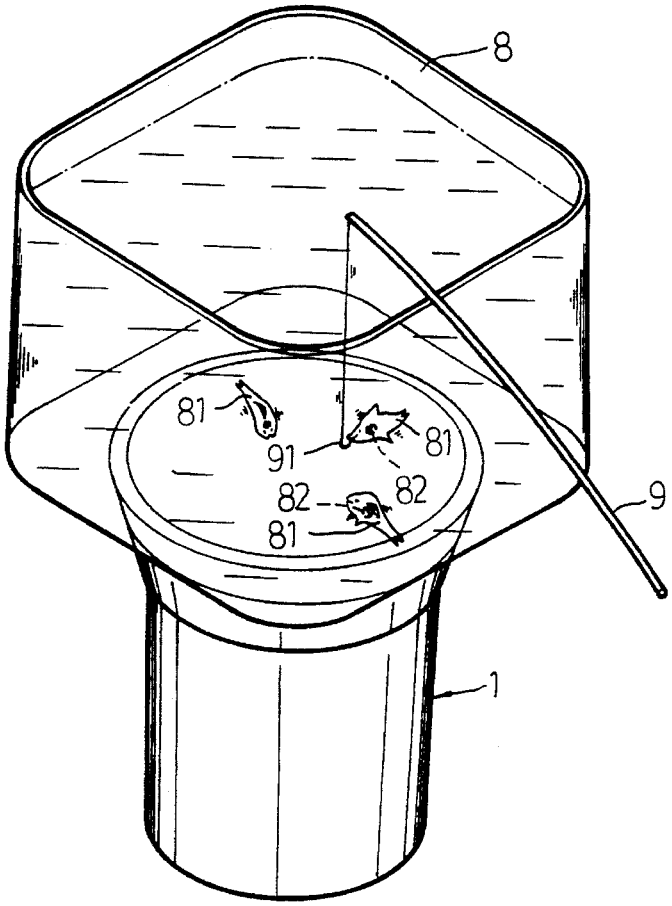
FIG. 6 illustrates an alternate form of the present invention.

Referring to FIG. 6, therein illustrated is an alternate form of the present invention, in which a water tank 8 is placed above the cover 6 to hold water and model fishes 81. Each model fish 81 has at least a permanent magnet 82 on the inside, which reacts with the permanent magnet 411 on the base 41 of the rocker arm 4. A fish hook 91 is suspended from a fishing rod 9 and dipped in the water carried in the water container to simulate the act of fishing.

While only a few embodiments of the present invention have been shown and described, it will be understood that various modifications and changes could be made without departing from the spirit and scope of the invention.

What is claimed is:

1. A magnetic force induced toy comprising:

a battery;

a cylindrical, top-open casing having a battery chamber at the bottom to hold the battery;

a substantially U-shaped holder frame fastened within said casing, said holder frame comprising a flat horizontal wall fixed to said casing above said battery chamber, and two vertical side walls vertically extended upwards from said horizontal wall at two opposite ends, each side wall having an elongated slot transversely disposed near the respective topmost edge;

an electromagnet fastened to said horizontal wall of said holder frame between said vertical side walls and electrically connected to the battery in said battery chamber to produce a magnetic field;

a rocker arm pivotably fastened between said vertical side walls of said holder frame, said rocker arm comprising two unitary side bars vertically extended downwards from two opposite ends of a horizontal base thereof, a top permanent magnet fastened to said horizontal base at the top in the middle, two permanent magnets respectively fastened to said side bars and aimed at said electromagnet to produce a respective magnetic repulsion, said side bars having each a pin hole respectively aligned with the elongated slot on either vertical side wall of said holder frame;

a pivot pin inserted through the elongated slot on each vertical side wall of said holder frame and the pin hole on each side bar of said rocker arm to suspend said rocker arm between the side walls of the holder frame, said pivot pin having two opposite ends each respectively fastened to the elongated slot on the vertical side walls of said holder frame by a respective cap;

a cover covering said casing at the top, said cover having a course guide sign to indicate the rocking direction of said rocker arm;

an operation control permanent magnet for moving or stopping said rocker arm; and at least one ornamental device respectively placed above said cover;

whereby said rocker arm is induced to oscillate on said pivot pin by placing said operation control permanent magnet on said cover with one pole facing toward the permanent magnet on said base of said rocker arm to produce a magnetic repulsion and then moving said operation control permanent magnet along said course guide sign; said rocker arm is stopped by placing the other pole of said operation control permanent magnet on said cover toward the permanent magnet on said base of said rocker arm to produce a magnetic attraction.

2. The toy according to claim 1 wherein said ornamental device comprises two round ornaments, each round ornament having a permanent magnet on the inside to react with the permanent magnet on said base of said rocker arm.

* * * * *